US008235743B2

(12) United States Patent
Fujisaki

(10) Patent No.: US 8,235,743 B2
(45) Date of Patent: Aug. 7, 2012

(54) CONNECTOR-MOUNT HAVING A LOCKING PIECE TO SECURE A CONNECTOR TO A BRACKET

(75) Inventor: Ryuichi Fujisaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 181 days.

(21) Appl. No.: 12/776,652

(22) Filed: May 10, 2010

(65) Prior Publication Data

US 2010/0291797 A1 Nov. 18, 2010

(30) Foreign Application Priority Data

May 13, 2009 (JP) ..... 2009-116756

(51) Int. Cl.
*H01R 13/627* (2006.01)

(52) U.S. Cl. ..... 439/352

(58) Field of Classification Search ..... 439/352–358, 439/157, 566–570
See application file for complete search history.

(56) References Cited

U.S. PATENT DOCUMENTS

| | | | | |
|---|---|---|---|---|
| 4,245,875 | A * | 1/1981 | Shaffer et al. | 439/144 |
| 6,305,945 | B1 * | 10/2001 | Vance | 439/35 |
| 6,830,472 | B1 * | 12/2004 | Wu | 439/358 |
| 6,860,749 | B1 * | 3/2005 | Wu | 439/352 |
| 6,890,205 | B1 * | 5/2005 | Wu | 439/358 |
| 7,435,125 | B2 | 10/2008 | Cummings et al. | |

* cited by examiner

*Primary Examiner* — Chandrika Prasad
(74) *Attorney, Agent, or Firm* — Gerald E. Hespos; Michael J. Porco

(57) ABSTRACT

A locking piece (51) posturing like a cantilever is disposed on a periphery of a connector (20) by extending the locking piece (51) forward from a rear side thereof along a direction in which the connector (20) is inserted into a mounting hole (12) of a bracket (10). A locking projection (55) which elastically locks a to-be-locked plate (13) formed at an upper side of the locking piece (51) by bending the bracket (10) rearward from an edge of the mounting hole (12) is formed by striking a part of the locking piece (51). When a force acts on the connector (20) in a removal direction, a tensile load acts on the locking piece (51). Therefore the locking piece (51) hardly deforms. Thereby it is possible to prevent the connector (20) from slipping off the bracket (10).

9 Claims, 11 Drawing Sheets

CONNECTOR-MOUNT HAVING A LOCKING PIECE TO SECURE A CONNECTOR TO A BRACKET

BACKGROUND OF THE INVENTION

1. Field of the Invention

The invention relates to a construction of mounting a connector on a mounting plate such as a bracket.

2. Description of the Related Art

U.S. Pat. No. 7,435,125 discloses a connector for electrically connecting a towing car and a car to be towed. The connector for the towing car is mounted on a bracket provided vertically on a lower portion of a rear end of the body of the towing car.

The connector for the towing car has a fit-in portion with an opening and a closing lid disposed at a rear end of the fit-in portion. A mating connector of the car to be towed is fit in the fit-in portion. The fit-in portion is inserted into a mounting hole formed in the bracket from a front end of the connector. A flange is formed on the peripheral surface of the connector and is capable of contacting the edge of the mounting hole of the bracket from the rear of the bracket. A metal elastic locking piece also is mounted on the peripheral surface of the connector and can lock the edge of the mounting hole from the front of the bracket. The elastic locking piece extends rearward from the front end thereof.

The front end of the connector for the towing car is inserted into the mounting hole of the bracket from the rear and the bracket causes the locking piece of the connector to displace elastically. The elastic locking piece elastically returns to its original state when the flange contacts the rear of the bracket at the edge of the mounting hole. The front end of the elastic locking piece locks the edge of the mounting hole from the front. Thus, the connector for the towing car is mounted on the vertically disposed bracket.

In the conventional connector-mounting construction, as described above, the elastic locking piece is a cantilevered rearward from the front side of the connector. The elastic locking piece locks the mounting hole, with the extended end thereof being applied to the edge of the mounting hole. A rearward pull force on the connector toward the car to be towed while the connector for the towing car is mounted on the bracket applies a force to the elastic locking piece and compresses the elastic locking piece longitudinally. Therefore there is a fear that the elastic locking piece will buckle and that the connector will separate from the bracket when the connector is pulled with a great force.

The present invention has been completed in view of the above-described situation. It is an object of the invention to prevent a locking piece from buckling and to hold a connector on a bracket at a high mounting strength.

SUMMARY OF THE INVENTION

The invention relates to a connector-mounting construction that includes a mounting plate with a bracket having a mounting hole. The connector-mounting construction also includes a connector with opposite front and rear ends. A fit-in portion is defined at the rear end of the connector and is configured to be fit on a mating connector. The front end of the connector is configured to be inserted into the mounting hole of the mounting plate from the rear. A flange is provided on a periphery of the connector and is configured to contact a rear surface of the mounting plate adjacent an edge of the mounting hole as the connector is inserted forwardly into the mounting hole. A metal locking piece is disposed on the periphery of the connector and deforms elastically as the front end of the connector is inserted into the mounting hole of the mounting plate. However, the locking piece elastically returns to an original state when the flange contacts the rear surface of the mounting plate. The locking piece is cantilevered forward on the periphery of the connector and extends along the insertion direction of the connector into the mounting hole. A locking projection is formed is formed near a front of the locking piece by striking a part of the locking piece. The locking projection locks a surface of the mounting plate adjacent the mounting hole when the flange contacts the rear surface of the mounting plate to lock the connector on the mounting plate.

A force that acts on the connector in a removal direction creates a tensile load acts on the locking piece. Therefore the locking piece hardly deforms and it is possible to securely prevent the connector from slipping off the bracket.

A to-be-locked plate is formed at the edge of the mounting hole of the mounting plate by bending the mounting plate and projects forward in the insertion direction of the connector. The locking projection of the locking piece locks a projecting edge of the to-be-locked plate. Therefore a long interval exists between the proximal end of the locking piece and the locking projection. Accordingly, the locking piece can be deformed easily when mounting the connector on the bracket.

An inclined guide surface is formed at an upper end of the locking piece and gradually approaches the connector. One end of the locking projection of the locking piece defines a steep locking surface, and an opposite surface of the locking projection is inclined. The inclined surface of the locking projection and the guide surface are continuous with each other and slidingly contact the to-be-locked plate for elastically deforming the locking piece. Therefore, the connector can be inserted smoothly into the mounting hole.

A high load may act on the locking piece, but will not deform the locking piece. Thus, the connector is mounted securely on the mounting plate.

DETAILED DESCRIPTION OF THE PREFERRED EMBODIMENTS

Figure 1:
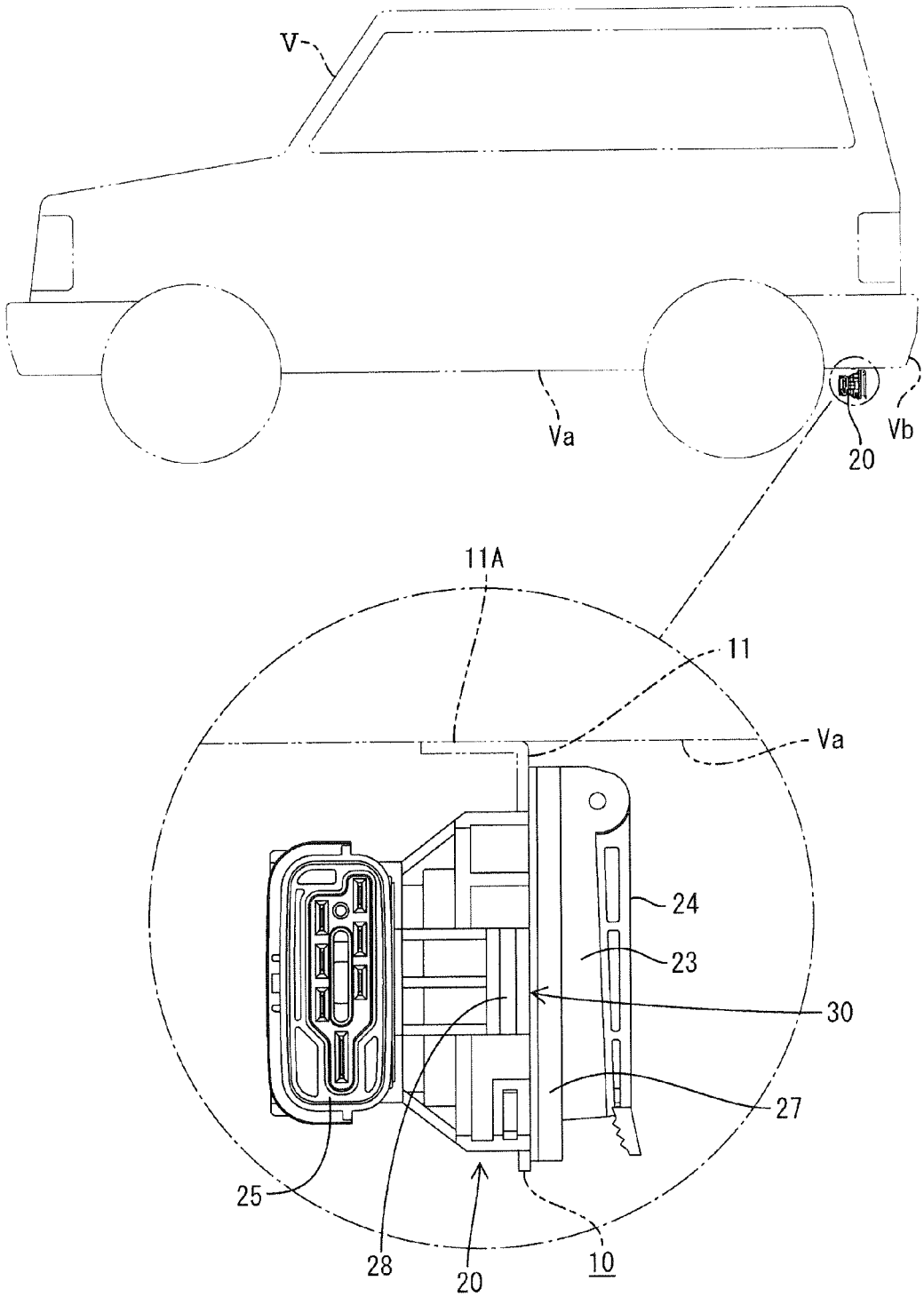
FIG. 1 is a left-hand side view showing a state in which a connector of one embodiment of the present invention is mounted on a car body.

A connector in accordance with the invention is identified by the numeral 20 in FIG. 1 and is used for electrically connecting a car V (towing car) to a trailer (car to be towed)

disposed behind the car V. The car V has a body Va and the connector 20 is disposed on a lower portion of a rear end of a car body Va of the car V via a bracket 10.

The bracket 10 is formed by press-molding a metal plate to define an inverted L-shape. More particularly, the bracket 10 has a vertically aligned body plate 11 and a mounting portion 11A that is bent to extend perpendicularly forward from the upper end of the body plate 11. The mounting portion 11A of the bracket 10 is mounted on a lower surface of a rear end of the car body Va at a position near and below the rear bumper Vb so that the body plate 11 extends vertically and along a width direction of the car body Va.

Figure 2:
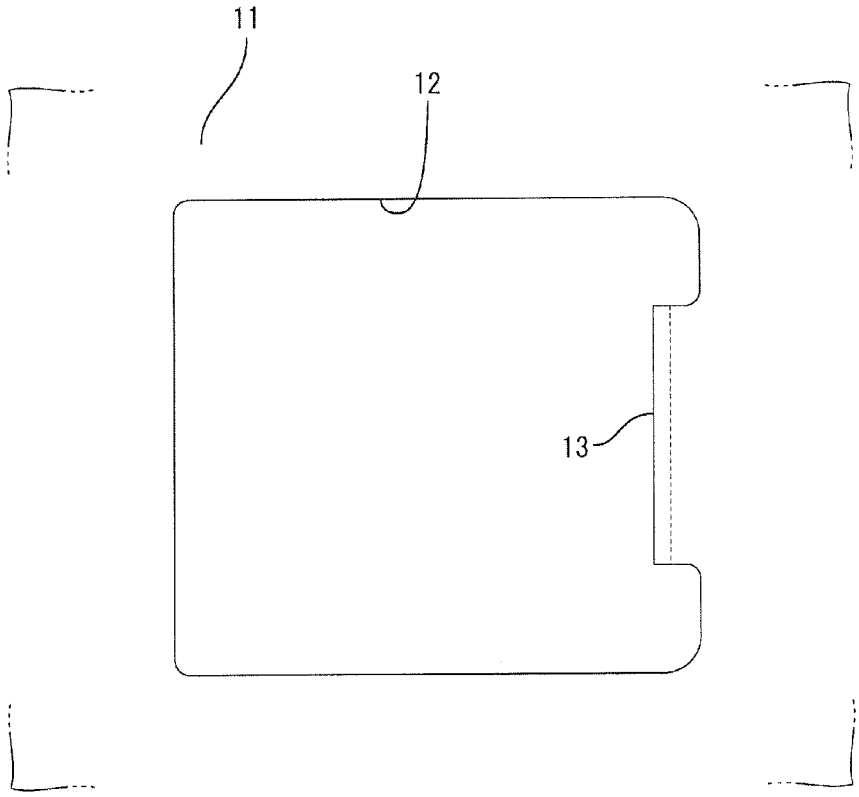
FIG. 2 is a front view showing a bracket.
Figure 9:
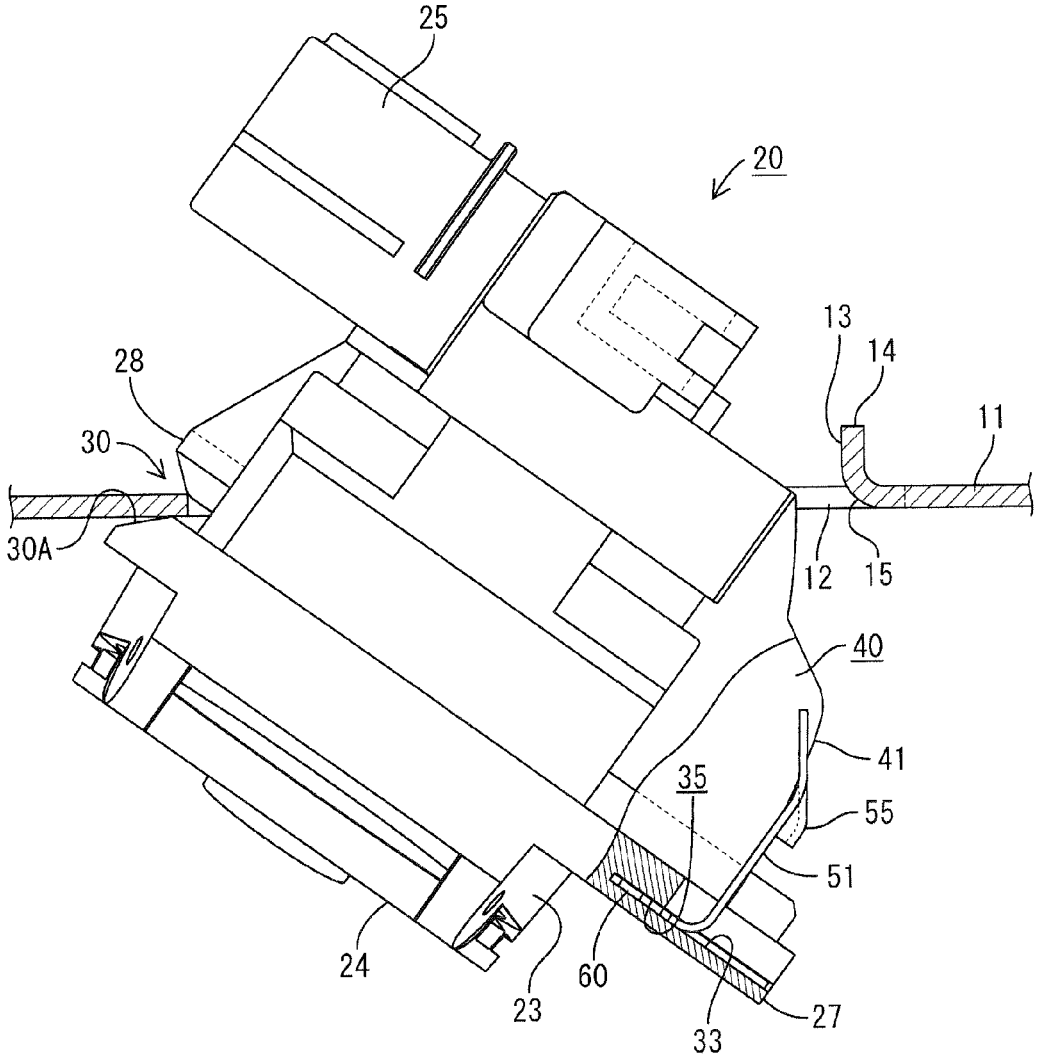
FIG. 9 is a partly cut-away plan view showing an early stage in an operation of mounting the connector on the bracket.

A generally rectangular mounting hole 12 is formed through the body plate 11, as shown in FIG. 2, and has a horizontal dimension slightly longer than the vertical dimension. A to-be-locked plate 13 projects in from the right side of the mounting hole 12, as viewed from the rear, and then is bent perpendicularly forward to define a hook shape, as shown in FIG. 9. The to-be-locked plate 13 is in a central height region of the mounting hole 12 and has a vertical extent equal to about one half of the height of the mounting hole 12. A to-be-locked edge 14 is defined at the forward end of the to-be-locked plate 13 and is to be locked to a locking piece 51 to be mounted on the connector 20, as explained below. A rounded portion 15 is defined at an outer surface of a bent portion of the to-be-locked plate 13.

Figure 4:
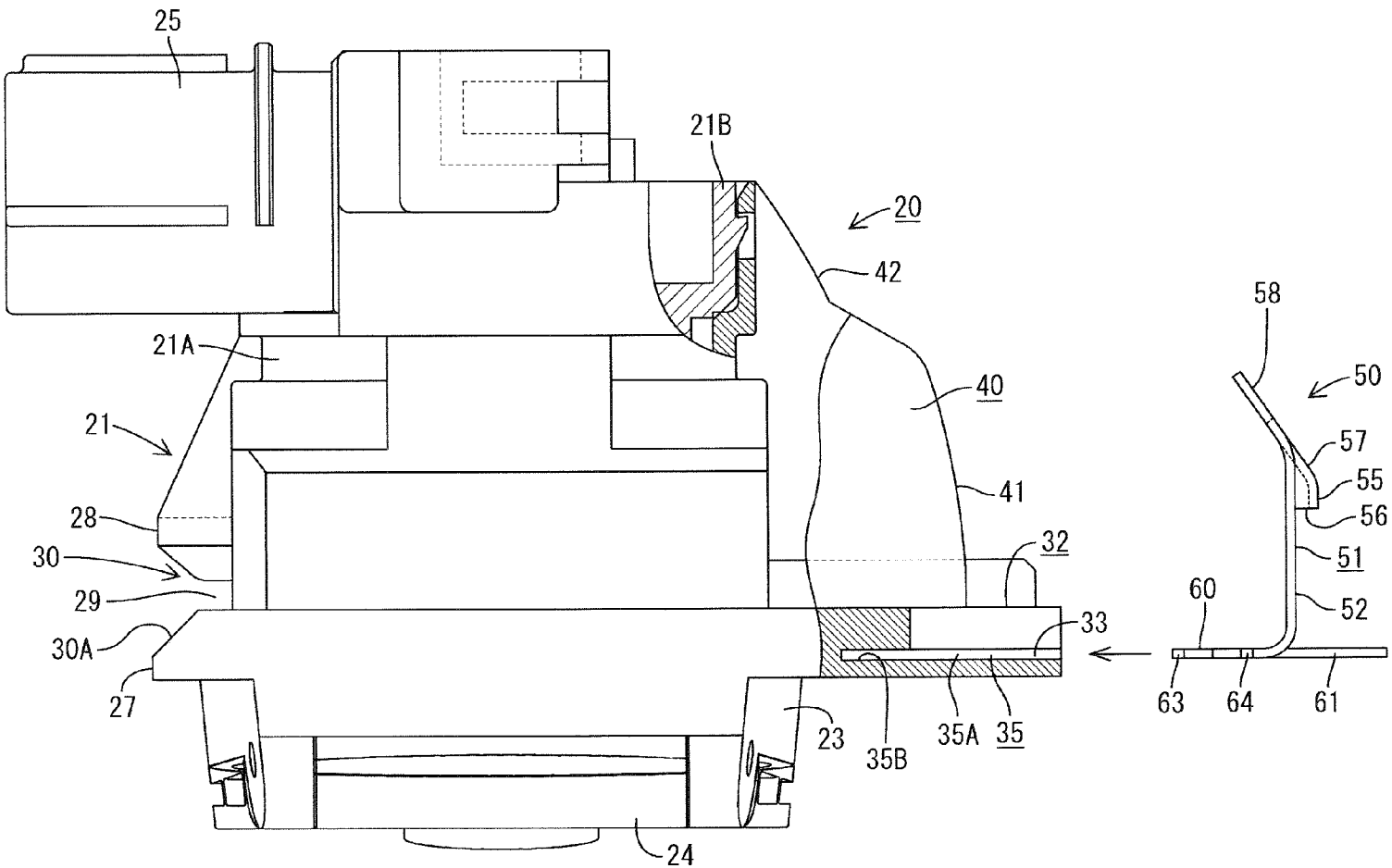
FIG. 4 is a partly cut-away plan view showing an operation of mounting a locking member on the connector.

The connector 20 has a housing 21 made of a synthetic resin. The housing 21 has a front end at the top in FIG. 4 and a rear end at the bottom in FIG. 4. A main housing 21A is defined at a rear part of the housing 21 and a sub-housing 21B is connected integrally to the main housing 21A to define a front part of the housing 21, as shown in FIG. 4.

A rear fit-in portion 23 is formed at a rear end of the housing 21. A mating connector (not shown) connected with a terminal of a wire harness drawn from the trailer can be fit in and connected to the rear fit-in portion 23. As shown in FIG. 1, a lid 24 is mounted pivotally on an upper edge of the rear fit-in portion 23.

A front fit-in portion 25 is formed at the front end of the housing 21 and extends perpendicularly to the left, as viewed from the rear. A connector connected with a wire harness drawn from the car V is fit in and connected to the front fit-in portion 25.

A terminal fitting (not shown) is mounted inside the housing 21 between the front fit-in portion 25 and the rear fit-in portion 23.

Figure 3:
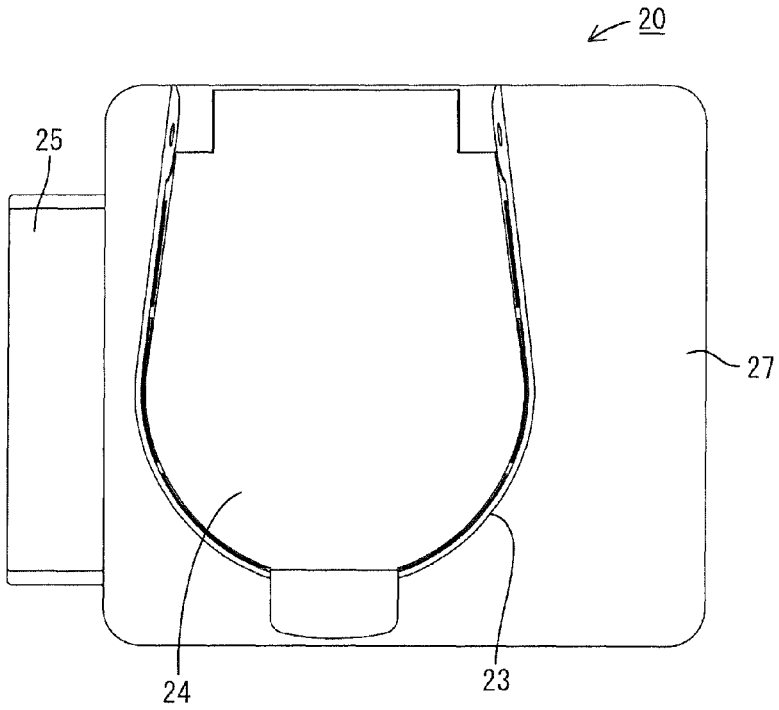
FIG. 3 is a front view showing the connector.

A flange 27 projects out from a peripheral surface of the housing 21 at a position near the rear end of the housing 21 and is more than twice as thick as the bracket 10. As shown in FIG. 3, the flange 27 is a wide rectangle that protrudes in a large area at a right side of the housing 21 and is slightly larger than the mounting hole 12 of the bracket 10.

As shown in FIGS. 1 and 4, a projection 28 protrudes from the left peripheral surface of the housing 21 at a predetermined height. The projection 28 is spaced forward from a left edge of the flange 27 by a distance slightly larger than the thickness of the bracket 10 to define a gap 29 that can receive an edge of the bracket 10 adjacent the mounting hole 12. More particularly, an edge of the bracket 10 at a central height portion of the mounting hole 12 and at a left side of the mounting hole 12 can fit in the gap 29 to be sandwiched between the flange 27 and the projection 28 with a clearance provided between the edge of the mounting hole 12 and the inner peripheral surface of the gap 29. The space between the left-hand edge of the flange 27 and the projection 28 is referred to herein as a sandwiching portion 30.

An outwardly flared inviting portion 30A is defined at an entrance to the sandwiching portion 30 by forming chamfers at a corner of the projection 28 and at a corner of a front surface of the flange 27 opposed to the projection 28.

Figure 5:
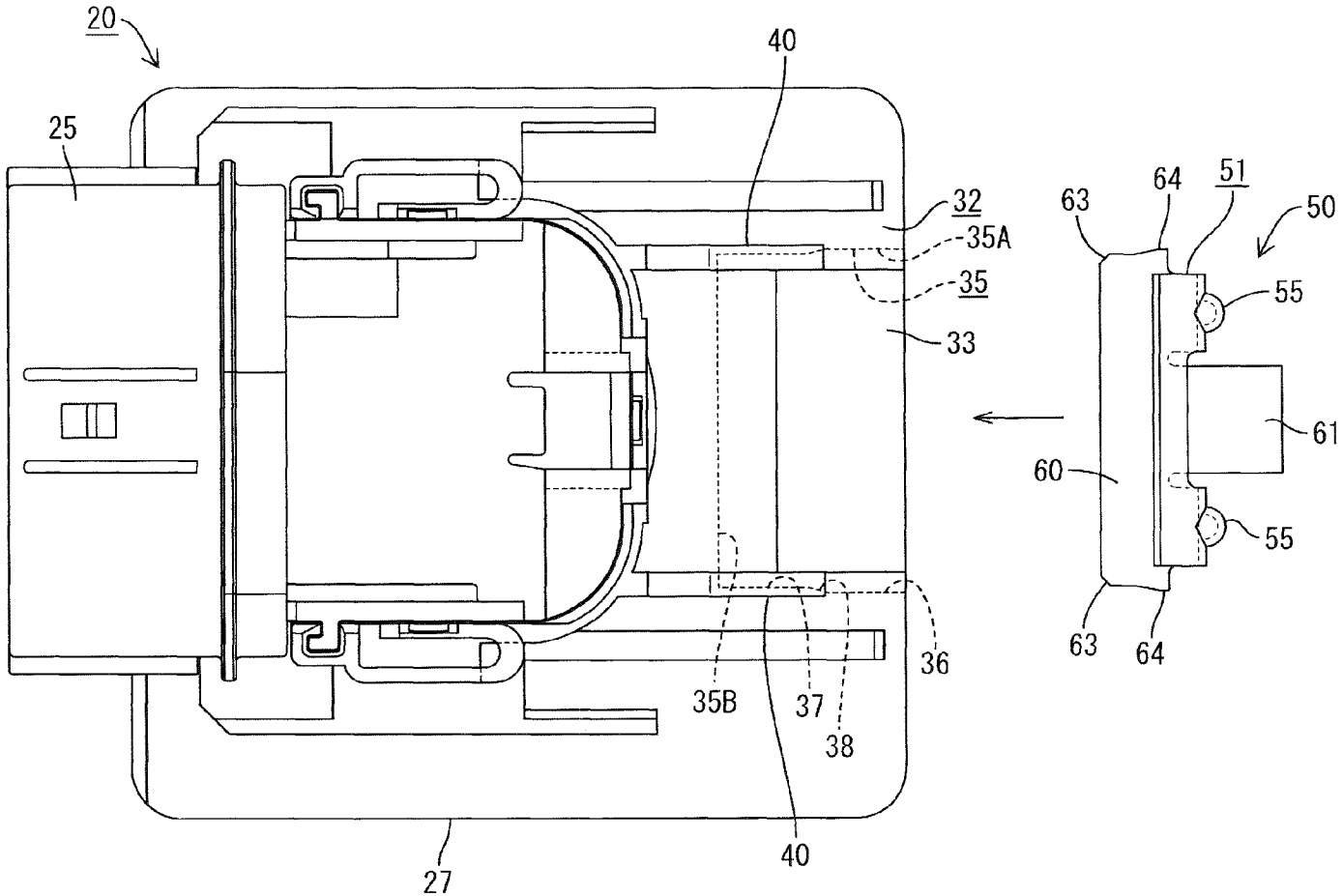
FIG. 5 is a rear view showing the operation of mounting the locking member on the connector.
Figure 6:
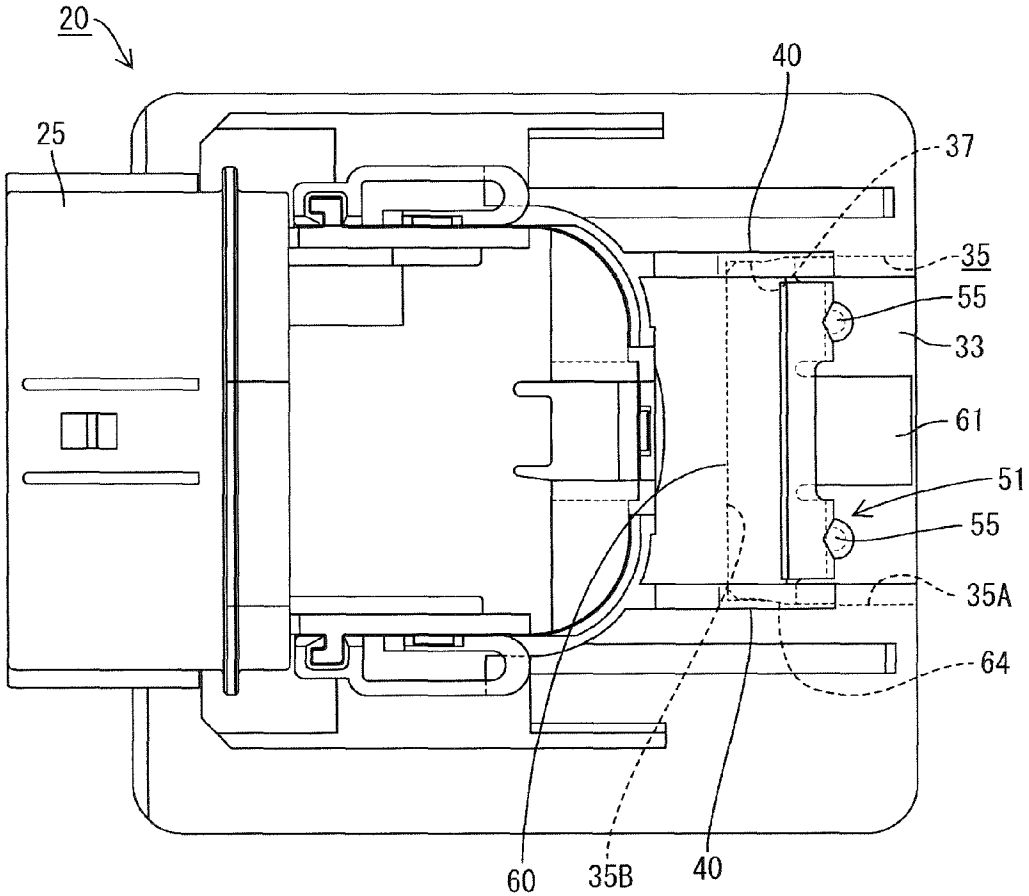
FIG. 6 is a rear view showing a state in which the locking member is mounted on the connector.
Figure 7:
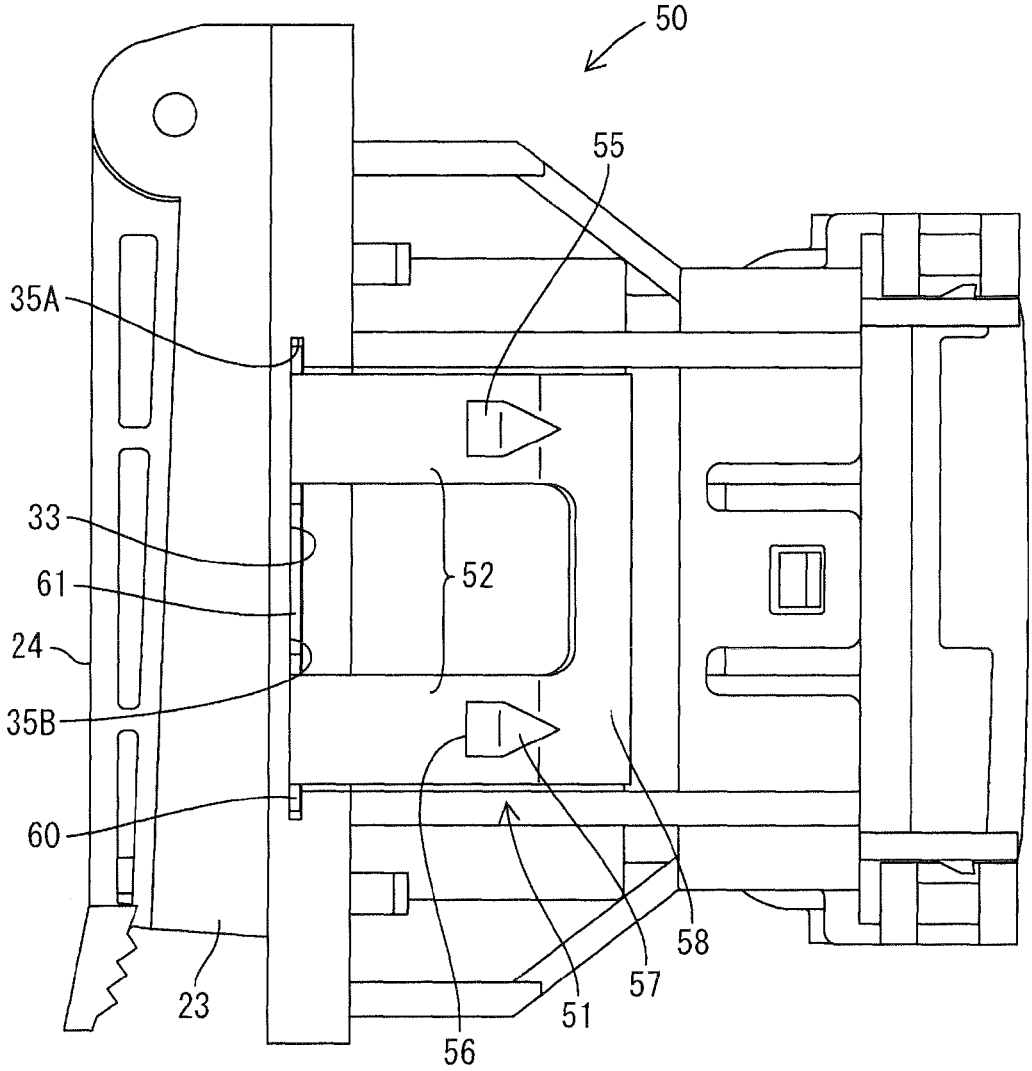
FIG. 7 is a right-hand side view showing the state in which the locking member is mounted on the connector.
Figure 8:
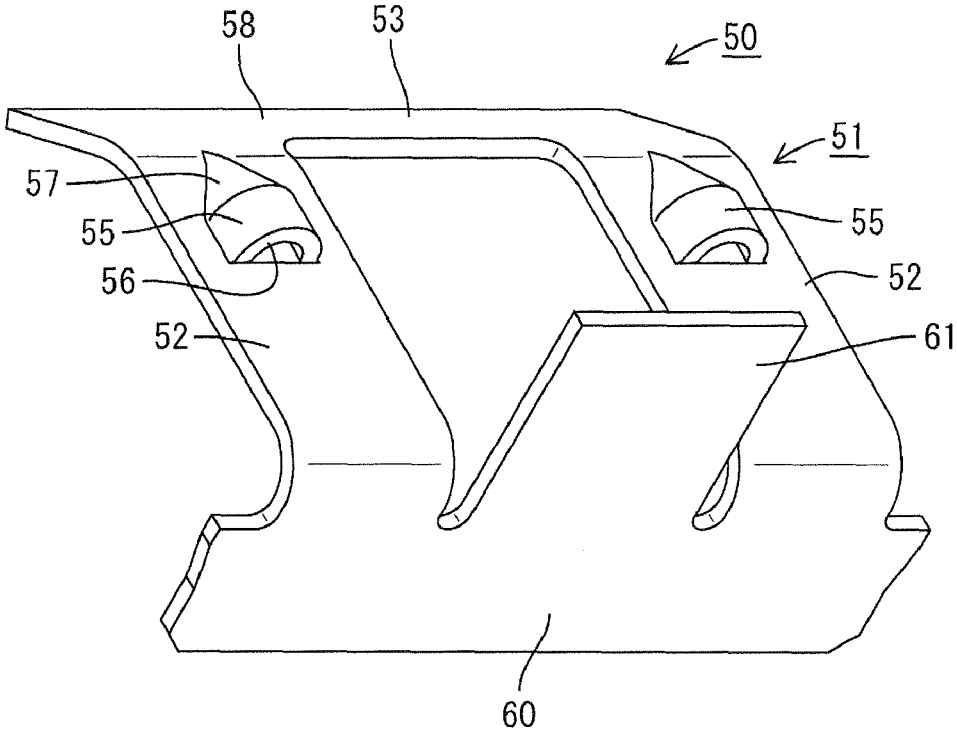
FIG. 8 is a perspective view showing the locking member.

A locking member 50 is mounted on a front surface of a right edge of the flange 27 as viewed from the rear. The locking member 50 is formed by press-molding a metal plate, such as spring steel. As shown in FIGS. 4, 5, and 8, the locking member 50 includes the above-referenced locking piece 51. The locking piece 51 has left and right spaced-apart arms 52 and a connection plate 53 that joins upper ends of the arms 52 to define a U-shape. A locking projection 55 is formed on an upper surface of each arm 52 of the locking piece 51. The locking projections 55 lock the to-be-locked plate 13 formed at a side edge of the mounting hole 12 of the bracket 10. A steep locking surface 56 is formed at a lower end of the locking projection 55 and an inclined surface 57 is formed on an outer surface of the upper portion of the locking projection 55. The connection plate 53 is bent down toward the back of the locking piece 51 from an upper end of each arm 52 and has a guide surface 58 that is continuous and flush with the inclined surfaces 57 of the locking projections 55.

An insertion plate 60 joins the arms 52 and is bent perpendicularly down from the lower ends of the arms 52 so that an upper edge of the insertion plate 60 is continuous with an end of each arm 52. The insertion plate 60 is a rectangle that is slightly wider than the locking piece 51. A seat 61 projects from a central portion of the upper edge of the insertion plate 60 between the arms 52 and is flush with the insertion plate 60.

As shown in FIG. 5, left and right side edges at the leading end of the insertion plate 60 are chamfered obliquely to form guides 63. A cut-into portion 64 is formed on the left and right side edges of the insertion plate 60 in a region whose area is less than the half of the entire area of a region upward from the guide portion 63. The cut-into portion 64 becomes gradually wider toward the rear of the insertion plate 60.

A mounting surface 32 for the locking member 50 is formed at the front side of the flange 27 and at the right side of the housing 21. The mounting surface 32 is at a central portion of the flange 27 in a width direction (vertical direction in FIG. 5). A square mounting concavity 33 is recessed in the mounting surface 32 and opens to the right, as shown in FIG. 4. The width of the mounting concavity 33 is dimensioned to receive the locking piece 51 of the locking member 50 therein. The depth of the mounting concavity 33 is longer than the projected length of the seat 61 of the locking member 50.

An insertion groove 35 is formed at a bottom portion of the mounting concavity 33 for receiving the insertion portion 60 of the locking member 50. The insertion groove 35 extends from left and right side walls thereof to a rear wall thereof. Additionally, the insertion groove 35 has a height slightly larger than the thickness of the insertion portion 60, as shown in FIG. 4. As shown with a dashed line of FIG. 5, side portions 35A of the insertion groove 35 are shallow to such an extent that the left and right side edges of the insertion portion 60 disposed outside the locking piece 51 can enter therein, whereas a rear portion 35B of the insertion groove 35 is deep to such an extent that most of the front side (lower side) of the insertion portion 60 can enter therein.

A wide portion 36 is formed at approximately a front half of the insertion groove 35 for almost tightly receiving the cut-into portion 64 of the insertion portion 60. A narrow portion 37 is formed at the rear of the insertion groove 35 for almost tightly receiving the front of the insertion portion 60 therein. A tapered portion 38 is formed between the wide portion 36 and the narrow portion 37 and becomes gradually narrower toward the rear end of the insertion groove 35.

Two guide walls 40 are formed on a front side of a portion of the flange 27 that projects on a right peripheral surface of the housing 21. The guide walls 40 align with side edges of the mounting concavity 33 and function to guide a pivotal motion of the connector 20 when inserting the connector 20 into the mounting hole 12, as explained below.

A circular arc-shaped portion 41 is defined on approximately one half of each guide wall 40 near the flange 27, as shown in FIG. 4. The circular arc-shaped portion 41 has a center at the sandwiching portion 30 and a radius equal to the interval between the left side edge of the mounting hole 12 and the to-be-locked plate 13 disposed at the right side edge of the mounting hole 12. An escaping portion 42 is defined at approximately the remaining half of the projected portion of the guide wall 40 and is disposed inward to prevent the guide wall 40 from interfering with to-be-locked plate 13.

Two guide walls 40 are formed on a front side of a portion of the flange 27 that projects on a right peripheral surface of the housing 21. The guide walls 40 align with side edges of the mounting concavity 33 and function to guide a pivotal motion of the connector 20 when inserting the connector 20 into the mounting hole 12, as explained below.

A circular arc-shaped portion 41 is defined on approximately one half of each guide wall 40 near the flange 27, as shown in FIG. 4. The circular arc-shaped portion 41 has a center at the sandwiching portion 30 and a radius equal to the interval between the left side edge of the mounting hole 12 and the to-be-locked plate 13 disposed at the right side edge of the mounting hole 12. An escaping portion 42 is defined at approximately the remaining half of the projected portion of the guide wall 40 and is disposed inward to prevent the guide wall 40 from interfering with to-be-locked plate 13.

The locking member 50 initially is mounted on the connector 20. More particularly, the insertion portion 60 of the locking member 50 is inserted into the insertion groove 35 on the flange 27 of the housing 21, as shown with arrow lines in FIGS. 4 and 5. The locking member 50 is inserted smoothly into the insertion groove 35, with the insertion portion 60 and the seat 61 sliding on the mounting concavity 33 and on the bottom surface of the insertion groove 35. The cut-into portion 64 of the insertion portion 60 reaches the narrow portion 37 disposed on the side surface of the insertion groove 3 near the end of the operation of mounting the connector 20 on the bracket 105. As a result, each cut-into portion 64 is press-fit into the corresponding side-wall side groove 35A with the cut-into portion 64 cutting into the side surface of the side-wall side groove 35A. The insertion operation is stopped when the front end of the insertion portion 60 strikes the rear surface of the rear-wall side groove 35B. At this time, the cut-into portion 64 acts as a catch. Thus, the locking member 50 is mounted irremovably on the rear-wall side groove 35B.

At this time, as shown in FIG. 9, the locking piece 51 projects forward at a right angle to the front surface of the flange 27. The interval between the front surface of the flange 27 and the locking surface 56 of the locking projection 55 formed on the locking piece 51 and the interval between the surface of the bracket 10 and the to-be-locked edge 14 of the to-be-locked plate 13 are set almost equally to each other.

The connector 20 with the locking member 50 mounted thereon is positioned so that the front fit-in portion 25 is in an oblique posture and facing sideways, as shown in FIG. 9. The connector 20 then is inserted into the mounting hole 12 of the bracket 10 from the rear. Thereafter the left side edge of the bracket 10 at the mounting hole 12 is retained by the sandwiching portion 30. In this state, the connector 20 is pivoted counterclockwise about the sandwiching portion 30 in FIG. 8 to allow the connector 20 to be vertical.

Figure 10:
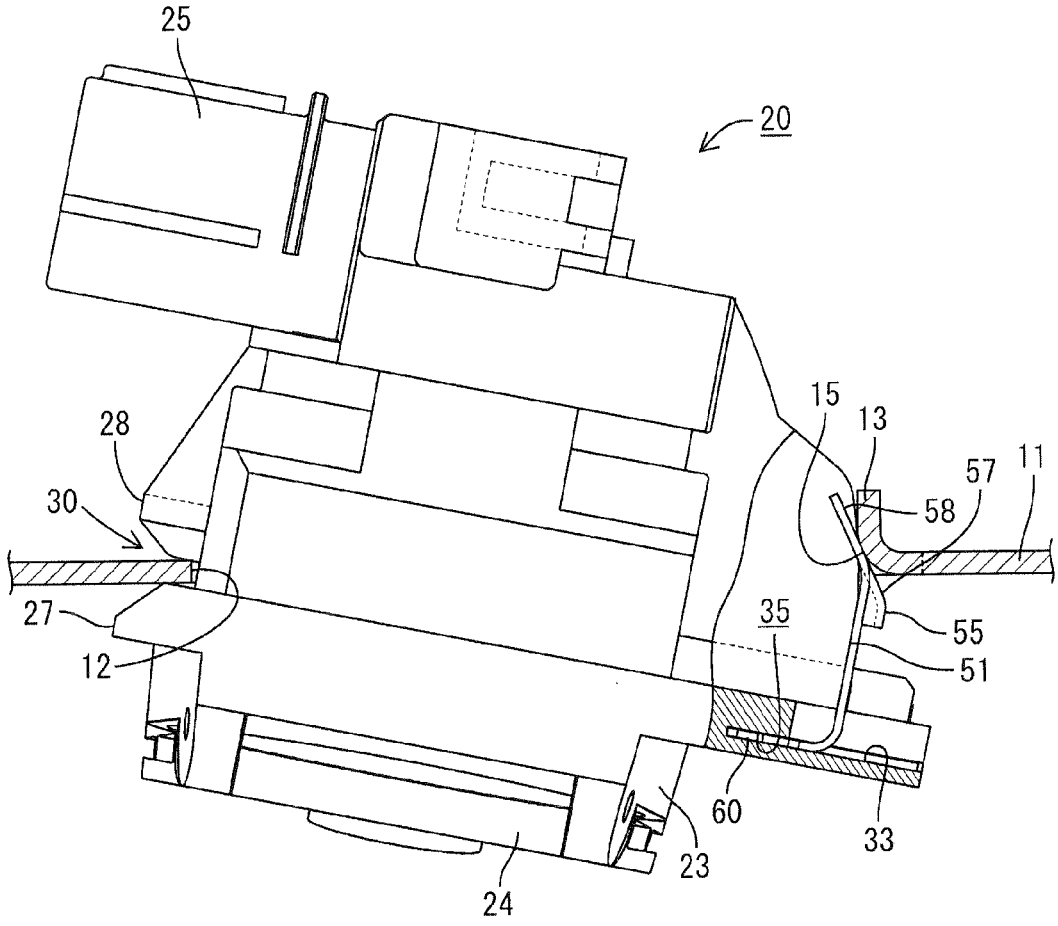
FIG. 10 is a partly cut-away plan view showing a last stage in the operation of mounting the connector on the bracket.

The circular arc-shaped portions 41 of the guide walls 40 strike and slide on the upper and lower ends of the to-be-locked plate 13 at the right side of the mounting hole 12, as the connector 20 pivots farther. As shown in FIG. 10, the guide surface 58 disposed at the upper end of the locking piece 51 strikes the rounded portion 15 disposed at the proximal end of the to-be-locked plate 13 as the operation of pivoting the connector 20 progresses further. The inclined surface 57 of the locking projection 55 rides on the rounded portion 15 and the locking piece 51 is deformed elastically inward. Thus, the locking projection 55 moves forward and slides on the inner surface of the to-be-locked plate 13.

Figure 11:
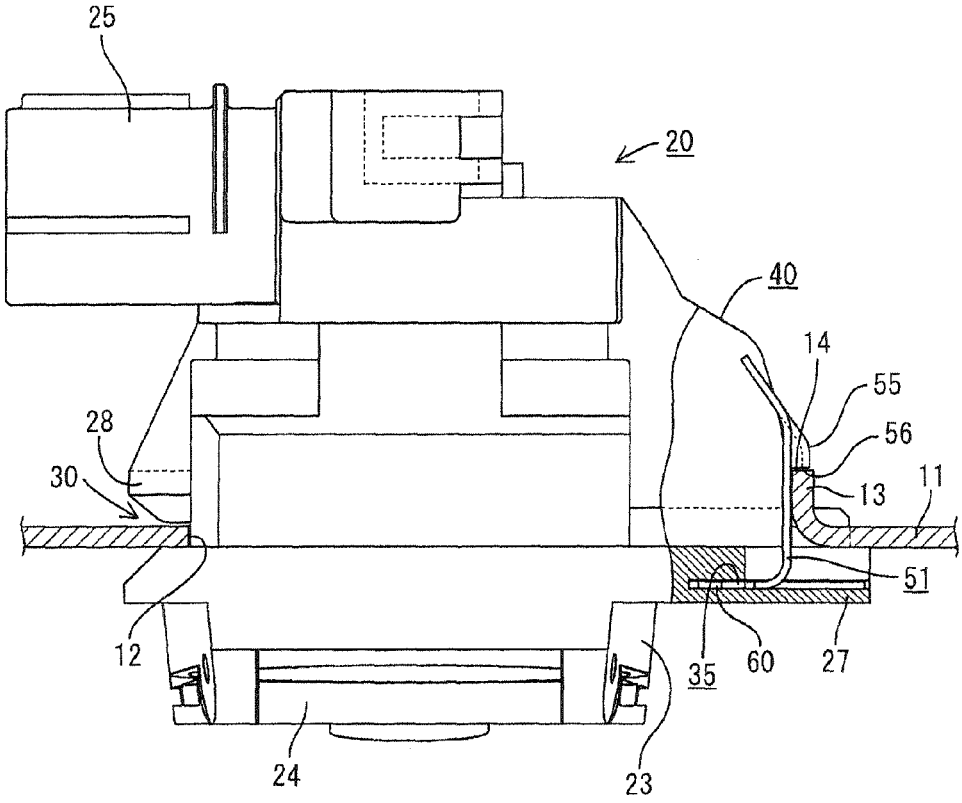
FIG. 11 is a partly cut-away plan view showing a state in which the connector has been mounted on the bracket.

The right side edge of the flange 27 strikes a surface forward of the right edge of the mounting hole 12 when the connector 20 is pivoted into a vertical posture, as shown in FIG. 11. Thus, further pivotal motion of the connector 20 is stopped. At that time, the locking projection 55 of the locking piece 51 passes the to-be-locked edge 14 of the to-be-locked plate 13 and the locking piece 51 returns resiliently to its original state. As a result, the locking surface 56 of the locking projection 55 locks the to-be-locked edge 14 of the to-be-locked plate 13. The left side edge of the mounting hole 12 is retained by the left side of the connector 20 at the sandwiching portion 30. Thus, the connector 20 is mounted unremovably on the body plate 11 of the bracket 10.

The connector drawn out of the car V is fit in the forwardly facing front fit-in portion 25 of the connector 20. The connector at the trailer side then is fit in and connected to the rear fit-in portion 23 with the opening and closing lid 24 opened.

The embodiment provides the following advantages.

The locking piece 51 is cantilevered forward in the insertion direction of the connector 20. The locking projection 55 formed at the upper end of the locking piece 51 is inserted into the mounting hole 12 of the bracket 10 from the rear, thus locking the to-be-mounted plate 13 that projects forward from the edge of the mounting hole 12, thereby mounting the connector 20 on the bracket 10. A pulling force on the wire harness drawn out of the trailer acts on the connector 20 in a removal direction, as shown with the arrow line of FIG. 11, and creates a tensile load on the locking piece 51. Thus the locking piece 51 hardly deforms and the connector 20 is prevented from slipping off the bracket 10.

The to-be-locked plate 13 projects forward from the edge of the mounting hole 12 by bending the body plate 11 of the bracket 10. The locking projection 55 at the upper end of the locking piece 51 locks the to-be-locked edge 14 at the upper end of the forwardly projected to-be-locked plate 13. Therefore a long interval can be taken between the proximal (lower) end of the locking piece 51 and the locking projection 55. As a result, the locking piece 51 can be deformed easily to mount the connector 20 on the bracket 10.

The guide surface 58 at the upper end of the locking piece 51 inclines and gradually approaches the connector 20. The outer surface of the upper portion of the locking projection 55 defines the downward inclined surface 57 and is continuous with the guide surface 58. The guide surface 58 at the upper end of the locking piece 51 and the inclined surface 57 of the locking projection 55 contact the rounded portion 15 of the to-be-locked plate 13 as the locking piece 51 is inserted into the insertion groove 35. Thus, the locking projection 55 slides in contact with the to-be-locked plate 13 and elastically deforms. Therefore the locking piece 51 can be inserted smoothly into the insertion groove 35 and the connector 20 can be inserted easily into the mounting hole 12.

The invention is not limited to the embodiments described above with reference to the drawings. For example, the following embodiments are also included in the technical scope of the present invention.

In the above-described embodiment, the locking projection of the locking piece locks the to-be-locked plate formed at the edge of the mounting hole by bending the body plate of the bracket. But it is possible to adopt a construction in which the locking projection of the locking piece directly locks the back-side edge of the mounting hole.

The locking piece-mounting construction is not limited to the type in which the insertion portion formed at the proximal end (lower end) of the locking piece is radially inserted into the insertion groove formed on the periphery of the connector. Rather, the insertion portion can be inserted axially into the insertion groove.

In the above-described embodiment, only one side of the connector is elastically locked. However, when the connector is configured to be inserted into the mounting hole of the bracket with the connector having a vertical posture, both sides of the connector may be locked to the locking piece.

In addition to the connector for the towing car, the present invention is applicable to a case in which connectors for other uses are mounted on the bracket.

In addition to the bracket, the present invention is applicable to a case in which the connector is mounted on a mounting plate, such as a panel where a mounting hole is formed.

What is claimed is:

1. A connector-mounting construction comprising:

a bracket having opposite front and rear surfaces and a mounting hole extending through the bracket from the front surface to the rear surface;

a connector having opposite front and rear ends, the front end being configured to be inserted into the mounting hole of bracket from the rear, a fit-in portion defined at the rear end of the connector and configured to be fit on a mating connector, a flange on a periphery of the connector and configured for contacting a front surface of the bracket substantially adjacent the mounting hole; and a metal lock including a locking piece cantilevered forward along the periphery of the connector, at least one locking projection struck to extend from the locking piece, the locking projection being disposed and configured to be elastically deformed by the bracket as the front end of the connector is inserted into said mounting hole and elastically returning substantially to an original state thereof when the flange contacts the front surface of said bracket so that the locking projection engages a forward facing part of the bracket in proximity to the locking hole and cooperates with the flange for locking the connector to the bracket.

2. The connector-mounting construction of claim 1, wherein a to-be-locked plate is bent from the bracket and projects forward in proximity to the mounting hole, the forward facing part of the bracket that is engaged by the locking projection being a forward facing edge of the to-be-locked plate.

3. The connector-mounting construction of claim 2, wherein the locking piece includes a guide surface inclined to gradually approach the connector, the locking projection having a locking surface in opposed facing relationship to the flange and an inclined surface extending continuously from the guide surface.

4. The connector-mounting construction of claim 3, wherein lock includes an insertion portion mounted in the flange of the connector, the locking piece being cantilevered forward from the insertion portion.

5. The connector-mounting construction of claim 4, wherein the guide surface is at an end of the locking piece remote from the insertion portion.

6. The connector-mounting construction of claim 4, wherein the locking piece comprises first and second arms cantilevered forward from the insertion portion and a connecting plate extending unitarily between ends of the arms remote from the insertion portion.

7. The connector-mounting construction of claim 6, wherein the guide surface is on the connecting plate.

8. The connector-mounting construction of claim 7, wherein the at least one locking projection comprises first and second locking projections disposed respectively on the first and second arms.

9. The connector-mounting construction of claim 8, wherein each of the locking projections has one of the inclined surfaces that is substantially coplanar with the guide surface.

* * * * *